United States Patent [19]

Bowcott

[11] Patent Number: 4,534,326

[45] Date of Patent: Aug. 13, 1985

[54] STOP/START ENGINE CONTROL FOR A ROAD VEHICLE

[75] Inventor: Roy P. Bowcott, Solihull, England

[73] Assignee: Lucas Industries, England

[21] Appl. No.: 607,470

[22] Filed: May 7, 1984

[30] Foreign Application Priority Data

May 7, 1983 [GB] United Kingdom ..... 8312651

[51] Int. Cl.[3] ..... F02N 17/00

[52] U.S. Cl. ..... 123/179 B; 123/179 BG; 123/198 DC

[58] Field of Search ..... 123/179 B, 179 BG, 179 R, 123/198 DC

[56] References Cited

U.S. PATENT DOCUMENTS

| | | | |
|---|---|---|---|
| 3,872,316 | 3/1975 | Kurii et al. | 123/179 B |
| 4,006,723 | 2/1977 | Schmidt | 123/179 BG |
| 4,286,683 | 9/1981 | Zeigner et al. | 123/179 B |
| 4,331,880 | 5/1982 | Dittman et al. | 123/179 BG |
| 4,362,133 | 12/1982 | Malik | 123/179 BG |
| 4,364,343 | 12/1982 | Malik | 123/179 B |
| 4,402,286 | 9/1983 | Pagel et al. | 123/179 B |

*Primary Examiner*—Ira S. Lazarus

*Attorney, Agent, or Firm*—Andrus, Sceales, Starke & Sawall

[57] ABSTRACT

A stop/start engine control for a road vehicle has a relay with its winding in series with a driver operable stop switch and an accelerator pedal switch. The relay contact is connected to provide latching action which can be broken by opening the accelerator pedal switch. In the reset position of this relay contact, a clutch pedal operated switch controls another relay operation of which is inhibited when the engine is running. This other relay controls the engine starter motor control system. Thus, when required the engine can be stopped by closing the driver operable switch while the accelerator pedal is closed. The engine can be restarted by first pressing the accelerator pedal to reset the first-mentioned relay, and then pressing the clutch pedal.

8 Claims, 1 Drawing Figure

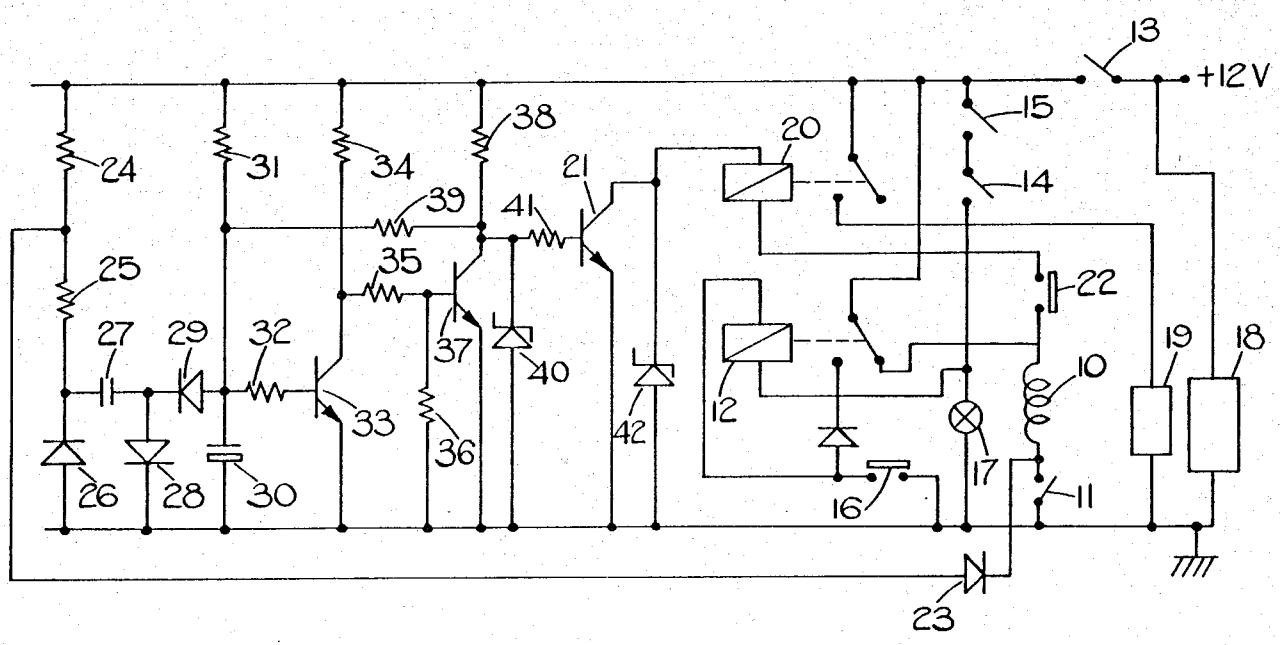
+12V
13
18
19
15
14
22
10
11
17
23
16
20
12
42
21
38
41
40
39
37
36
34
35
33
31
32
30
29
28
24
25
27
26

STOP/START ENGINE CONTROL FOR A ROAD VEHICLE

This invention relates to a stop/start engine control for a road vehicle, whereby, to save fuel and reduce noxious exhaust emissions the vehicle engine can be stopped when the vehicle is stationary and restarted when it is required to recommence vehicle movement.

Various proposals have previously been made for stop/start engine controls which involve the use of a switch to detect the position of either the accelerator pedal or the clutch pedal of the vehicle to control re-starting. Neither of these previously proposed arrangements is, however, satisfactory in that where the accelerator pedal alone is used, damage to the starter gearing and noise can result from a driver pumping the accelerator pedal to assist hot restarting, and where the clutch pedal alone is used the system will be defeated by a driver who habitually waits in traffic with the clutch pedal depressed.

It is an object of the invention to provide a stop/start engine control in which these drawbacks are overcome.

A stop/start control in accordance with the invention comprises means for stopping the engine, means for re-starting the engine and engine running sensitive means for inhibiting said re-starting means when the engine is running, characterised by latch means which is set when said engine stopping means is actuated and inhibits operation of the re-starting means as long as it remains set, accelerator pedal sensitive means for resetting the latch means when the accelerator pedal is moved out of its rest position whilst the latch means is in its set position, and clutch pedal sensitive means for operating said restarting means when the latch means is in its reset condition.

An example of the invention is shown in the accompanying drawing which is an electrical circuit diagram of a stop/start engine control.

As shown in the drawing, the primary winding 10 of the ignition transformer has one end connected conventionally to the vehicle ground by a contact breaker 11. The other end of the winding 10 is connected via a normally closed contact of a first relay 12 to a +12 V rail controlled by the usual vehicle ignition switch 13. The relay 12 has its winding connected at one end to the +12 V rail by a series circuit comprising a manually operable normally open instantaneous contact switch 14 and an engine temperature sensing switch 15 which is open when the engine temperature is below a predetermined value and also open when the temperature is above an upper limit level. The other end of the winding of the relay 12 is connected to ground via a switch contact 16 which is sensitive to the accelerator pedal position. Switch 16 is closed when the accelerator pedal is in its rest position. Relay 12 is connected so as to be self-latching, i.e. its normally open contact is connected to said one end of the winding of relay 12. Thus relay 12 is energised when switches 14, 15 and 16 are all closed simultaneously and latches when switch 14 re-opens. The latch action is only reset when the switch 16 is opened. As shown, the normally-open contact of relay 12 is connected to ground by a warning lamp 17 which signals when the relay 12 is in its latched or set condition.

The starter motor 18 of the vehicle is controlled by a starter relay 19 which is in turn controlled by the normally-open contact of a second relay 20. Relay 20 has one end of its winding grounded via the collector-emitter path of an npn transistor 21 and the other end connected to the +12 V rail via a clutch pedal operated switch 22 which is closed when the clutch pedal is depressed far enough to disengage the clutch, in series with the normally-closed contact of the relay 12. Thus, the starter can be energised only when the clutch pedal is depressed, the relay 12 is in its reset condition and the transistor 21 is conductive.

The transistor 21 is controlled by an engine-running sensitive means which derives its input from the contact breaker 11. To this end the non-grounded side of the contact breaker 11 is connected to the cathode of a diode 23, the anode of which is connected to the junction of two resistors 24, 25 which are connected in series between the +12 V rail and the cathode of a diode 26. The anode of the diode 26 is grounded and its cathode is connected by a capacitor 27 to the anode of a diode 28 and the cathode of a diode 29. The cathode of diode 28 is grounded and the anode of diode 29 is connected to the negative side of an electrolytic capacitor 30, the positive side of which is grounded. A resistor 31 connects the negative side of capacitor 30 to the +12 V rail and another resistor 32 connects the same point to the base of an npn transistor 33 which has its emitter grounded. The collector of the transistor 33 is connected by a resistor 34 to the +12 V rail and by a resistor 35 and a resistor 36 in series to ground, the junction of reistors 35 and 36 being connected to the base of an npn transistor 27. Transistor 27 has its emitter grounded and its collector connected by a resistor 38 to the +12 V rail by a resistor 39 to the negative side of capacitor 30, by a zener diode 40 to ground and by a resistor 41 to the base of the transistor 21. The collector of transistor 21 is connected to ground by another xener diode 42 to protect transistor 21 against overvoltages generated by the relay winding 20 when transistor 21 is switched off to interrupt current in the winding 20.

In use, except when the engine is cold or very hot, the engine can be stopped by opening switch 14, whilst the accelerator pedal is in its rest position. This causes relay 12 to be energised and self-latched, thereby removing the supply to the ignition system. Components 23 to 29 act as a diode pump circuit which charges capacitor 30 to a negative voltage sufficient to turn transistor 33 off whenever the engine is running at a speed in excess of a predetermined level, e.g. 400 rpm (which is higher than cranking speed, but lower than idling speed). In this condition, transistor 37 is conducting and transistor 21 is off, so that relay 20 cannot be energised. When the engine is stopped by energisation of relay 12, capacitor 30 starts to discharge via resistor 31 until the transistor 33 turns on (after about 2 seconds), transistor 37 turns off, positive feedback via resistor 39 speeding up this switching action, and transistor 21 turns on, thus preparing relay 20 for energisation. Since relay 12 is latched, operation of the clutch pedal alone at this stage will have no effect, but if the relay 12 is reset by depression of the accelerator pedal, depression of the clutch pedal will cause energisation of relay 20 and operation of the starter. Relay 20 is de-energised automatically when the engine speed comes up to 400 r.p.m.

It will be noted that the driver can alternatively hold the clutch pedal depressed with the gear engaged and thereby be ready to move off from a stationary condition, simply by completing the final stage of re-starting, i.e. pressing the accelerator pedal to trigger starter cranking.

It will be noted that, in circumstances where the engine is not running, but relay 12 is not in its latched condition, e.g. on initial starting, or following a stall, the engine can be started without depressing the accelerator pedal, merely by depressing the clutch pedal.

Inhibition of stop/start operation at high engine temperatures is desirable, since in certain very high temperature conditions (e.g. mountain climbing or trailer/-caravan towing) it is desired to maintain forced coolant circulation to avoid engine damage by local overheating. Steam generation could also occur in such conditions if the engine were stopped.

Instead of using an engine temperature switch 15, this switch could, for example, be mechanically actuated by a manual choke control.

I claim:

1. A stop/start engine control for a road vehicle comprising means for stopping the engine, means for re-starting the engine and engine running sensitive means for inhibiting said re-starting means when the engine is running, characterised by latch means which is set when said engine stopping means is actuated and inhibits operation of the re-starting means as long as it remains set, accelerator pedal sensitive means for resetting the latch means when the accelerator pedal is moved out of its rest position whilst the latch means is in its set position, and clutch pedal sensitive means for operating said restarting means when the latch means is in its reset condition.

2. A stop/start engine control as claimed in claim 1 in which said latch means comprises a relay having a contact arranged to provide self-latching operation, and said accelerator pedal sensitive means is a switch which is closed when the accelerator pedal is in its rest position and which is connected in series with the winding of said relay.

3. A stop/start engine control as claimed in claim 2 in which said relay contact controls the engine ignition system and also a further relay constituting part of said restarting means.

4. A stop/start engine control as claimed in claim 3 in which said clutch pedal sensitive means comprises a further switch which is closed when the clutch pedal is depressed to disengage the clutch, the winding of said further relay being connected in series with said further switch.

5. A stop/start engine control as claimed in claim 4 in which said inhibiting means comprises a switch device which is conductive when the engine shaft is rotating at a speed less than a predetermined level and which is also connected in series with said further relay.

6. A stop/start engine control as claimed in any of claims 2 to 5 inclusive in which said means for stopping the engine comprises a normally open, driver closable switch in series with said first-mentioned relay winding.

7. A stop/start engine control as claimed in claim 6 further comprising a temperature override switch which is sensitive to engine temperature so as to open when the engine temperature is below a set level and which is in series with said driver closable switch.

8. A stop/start engine control as claimed in claim 6 further comprising a choke control sensitive switch which is closed only when a manual choke control of the vehicle is in a normal running position and which is connected in series with said driver closable switch.

* * * * *